US006189228B1

(12) United States Patent
Schuette

(10) Patent No.: US 6,189,228 B1
(45) Date of Patent: Feb. 20, 2001

(54) SUPPORT/HEAT VALVE FOR DRYER

(76) Inventor: Lyle Schuette, 15001 E. 79th St. South, Derby, KS (US) 67037

( * ) Notice: Under 35 U.S.C. 154(b), the term of this patent shall be extended for 0 days.

(21) Appl. No.: 09/358,235

(22) Filed: Jul. 21, 1999

(51) Int. Cl.[7] ..... F26B 19/00
(52) U.S. Cl. ..... 34/86; 34/235
(58) Field of Search ..... 34/82, 86, 134, 34/235, 606; D23/364

(56) References Cited

U.S. PATENT DOCUMENTS

| | | | | |
|---|---|---|---|---|
| 3,716,925 | * | 2/1973 | Hartung | 34/235 X |
| 3,999,304 | * | 12/1976 | Doty | 34/86 X |
| 4,122,612 | * | 10/1978 | Mrofchak | 34/86 |
| 4,137,647 | * | 2/1979 | Clark, Jr. | 34/86 X |
| 4,156,973 | * | 6/1979 | Bede | 34/86 |
| 4,388,766 | * | 6/1983 | Sanderson | 34/86 X |
| 4,395,831 | * | 8/1983 | Nielson | 34/86 |
| 4,530,170 | * | 7/1985 | Green | 34/86 X |
| 5,463,820 | * | 11/1995 | La Rue | 34/86 X |
| 5,590,477 | * | 1/1997 | Carfagno, Sr. | 34/235 |
| 5,666,739 | * | 9/1997 | Krueger | 34/86 |
| 5,806,207 | * | 9/1998 | Merrigan | 34/86 X |
| 5,819,435 | * | 10/1998 | Tuggle | 34/235 |

* cited by examiner

*Primary Examiner*—Stephen Gravini
(74) *Attorney, Agent, or Firm*—Bradley P. Sylvester

(57) ABSTRACT

An apparatus that directs the flow of heated air that is being discharged from a clothing dryer, in which the dryer is positioned upon a rigid support, that elevates the dryer above the normal ground surface. The dryer discharge hose is connected at one end to the dryer, and to a valve assembly, located beneath the dryer, housed in the dryer support. The valve may be actuated so that heated air is either directed to flow through the valve assembly, into another hose which vents directly outside, or through an interior discharge opening, so that heated air is reintroduced back into the dwelling. The apparatus is provided with an access door, so that the valve can be positioned as desired. If air is being reintroduced back into the dwelling, a removable air filtration system is provided. In the event that the air filtration system becomes overwhelmed with particulate matter, the valve has a safety flap which is actuated by increased air pressure, and allows the heated air to vent outside. This prevents possible risk of fire and damage to the dryer unit due to inability to discharge heated air.

5 Claims, 3 Drawing Sheets

SUPPORT/HEAT VALVE FOR DRYER

BACKGROUND OF THE INVENTION

This invention pertains to an apparatus that is intended to deal with waste energy heat loss that is typical with the use of ordinary household clothing dryers. A typical household clothing dryer heats air within a rotating compartment or drum, where moisture-laden clothing or similar materials are allowed to contact heated air that has been heated within the dryer. Since the heated air has an increased moisture carrying capacity, as compared to cooler air, moisture from the clothing will evaporate out of the clothing and be carried along within the heated air flow. The heated air is typically vented directly from a back side vent through a dryer vent hose, where the moisture-laden air is discharged through a port in the building wall that allows the air to be vented directly into the outside air.

During conditions where the outside air is extremely cold, wasted heat energy while using the clothing dryer is even more pronounced. This is due to the fact that heated air is discharged outside the dwelling, causing the energy to be lost from the dwelling, but the dryer must also concurrently draw in air from inside the dwelling, to replace the vented heated air. When air is drawn into the dryer, and then eventually vented outside the dwelling, the air which is vented outside must be replaced by air from within the dwelling. As air is removed from the dwelling into the dryer unit, external air must replace said dwelling air. If the replacement air comprises outside cold air, as would typically be the case, the clothing dryer is not only wasting heat energy it produces by venting it outside, but it is also removing warm air from within the dwelling.

Prior art has attempted to overcome the heat loss associated with clothing dryers. U.S. Pat. No. 5,806,207 (Merrigan) is a recent example. This device provides a cabinet for the collecting of air that has been heated by the dryer. A single vent is used as a means to direct the air heated by the dryer back into the house or dwelling. A second outlet is provided as a means to divert the heated air outside the dwelling.

One of the drawbacks with the prior art is that no means is provided to capture lint and other associated fabric particles that are generally present in air being discharged from clothing dryers. While most dryers have some type of a lint capturing device, such devices are generally not completely efficient. Utilization of the prior art, without the inclusion of the advantages shown in this invention, can result in a returned of heated air back into the dwelling, along with a great deal of undesired lint and dust particles.

Another drawback with the prior art is that there is no means to specifically direct the flow of air heated by the dryer to either the dwelling interior or to the outside. Prior art relies on an increased air pressure, coupled with various vent openings supplied, to direct the air out from a single volume staging area within a cabinet. Unless the discharge vent that directs air into the house or dwelling is completely airtight, heated air will return back into dwelling even at undesired times. Because dryers may have the tendency to over heat if their discharge air pathway is restricted, there should be provided an unobstructed passage to both vent the heated air back into the dwelling as well as a vent to discharge heated air directly outside dwelling.

A further drawback to the prior art is that the cabinet used in the Merrigan patent will acquire significant heat energy, which will then be able to be transferred to the adjacent air within the dwelling. While this may be a desired benefit during cold weather, this heat transfer is undesirable during hot summer months when the owner may be attempting to cool the dwelling interior air through air conditioning.

SUMMARY OF THE INVENTION

This invention utilizes a dryer support that is placed underneath a typical clothing dryer. This dryer support is not intended to provide any type of airtight cabinet, but is provided so as to allow the unobstructed placement of various vent hoses and a valve beneath the dryer. The vent hoses are those typically used with clothing dryers, having a diameter of at least several inches. Since these hoses are typically unable to resist very much external crushing pressure, they must be protected from the weight of the dryer, and housed within the support.

The dryer support should be provided with an open back side, to allow vent hoses to be inserted into the interior space defined by the dryer support. It is also advantageous for a portion of the top side area of the dryer support to be either removed or removable, so as to provide complete access to the space defined by the interior of the dryer support.

Located on the front side of the dryer support is an interior discharge opening, which defines a passageway from the support interior back into the dwelling room. This opening may be of any size or shape, but should define an opening that has approximately the same cross-sectional area as that of the dryer vent hose.

A valve assembly is provided within the interior space of the dryer support. This valve assembly defines three openings, that are each accessible to the other openings. This valve assembly has a means by which a dryer vent hose may be attached so that air moving through the dryer vent hose enters freely into the valve assembly. Once this air moves into the valve assembly, it is directed either through the valve assembly into an exterior vent hose, or is diverted through the use of a valve flap, so that the air passes through the interior discharge opening back into the dwelling room. The valve flap therefore covers either one of the openings within the valve assembly, be the interior discharge opening, or opening leading to the exterior vent hose.

When air, that has been heated by a clothing dryer, is intended to be directly vented to the outside of the dwelling, the valve flap is placed over the interior discharge opening, so that any air moving through the dryer vent hose into the valve assembly will vent directly through the exterior vent hose to the outside air. The support itself is not appreciably heated during this process.

When air, that has been heated by a clothing dryer, is intended to be vented into the dwelling, so as to recapture that heat energy it contains, the valve flap is moved so that it covers the exterior vent hose port, so that heated air moving through the dryer vent hose, into the valve assembly, will be diverted so that flows through the interior discharge opening in the front of the dryer support, back into the dwelling. As the interior discharge opening is located directly below the clothing dryer, this allows the heated moist air to be vented directly into the dwelling interior, with the heated air stream being propelled several feet out into the dwelling room. The moist air provides the added benefit of humidifying the interior air, since the present air has typically been heated in a furnace which altered the humidity level. P Heated air, that is exiting a clothing dryer, will typically have lint particles being transported along with the air flow. These lint particles will be those that have escaped through any previous lint filtration means. While the amount of lint does not comprise a sizable volume, it is still generally undesired to have this air flow being directly vented into a home or occupied dwellings, as these particles will provide irritation to nasal passages when breathed, or cause dust-like deposits on household surfaces.

A removable filter is provided, which covers the interior discharge opening in the front of the dryer support, where said filter has a means to trap a majority of the lint particles in the venting air stream. Since particulate matter can quickly cause a filtration means to inhibit air flow, the screen is removable, so that it can be cleaned of particulate matter when necessary.

In the event that the removable filter becomes highly impacted with lint material, so that the air flow through the removable filter is unduly restricted, it is necessary to provide a bypass means, so that the flow of heated air from the dryer is not restricted, which could cause over heating to the actual dryer unit.

A secondary bypass flap is preferably provided within the valve flap itself, so that it allows heated air that is pressurized within the valve assembly to exit directly into the exterior vent hose, even if the valve flap covers the exterior vent opening. This secondary bypass flap functions as an emergency pressure release valve.

Access to the valve assembly is through a door located on the front of the dryer support, which allows the person to reach in and manipulate the flap handle to direct the flow of air.

A further benefit of this invention is that all of the heated air moves through the vent hoses and the valve apparatus. The dryer support frame itself does not contact the heated air flow. The benefit to this arrangement is that the support frame does not acquire heat energy and transfer the same to the interior dwelling air, when no heat recovery is desired, such as during the summer time.

The height of the invention is preferably no more than nine inches, so that the dryer support is able to fit under the average household clothing dryer, so that it elevates said dryer a minimal distance, which allows the dryer to remain within prior construction limitations. In many instances, where there is a shelf, or other preexisting obstruction above a clothing dryer, normal construction places these obstructions at least nine inches above the normal top side surface of a dryer unit. Therefore, this invention, when kept within a nine inch height restriction, is able to be used with virtually all preexisting dryer units.

It is one of the objects of this invention to provide a support frame to position a dryer off of the ground so that a dryer vent hose can be placed underneath the dryer without restricting air flow through the vent hose, where said dryer vent hose is able to be connected to a valve assembly that directs air flow either back into the dwelling or directly outside.

It is a further object of this invention to provide a means to trap and remove lint particulate matter within the moving heated air stream, after said air has been discharged into the dryer vent hose, where the means to trap lint particular matter is able to be removed from the valve assembly and cleaned when necessary.

It is a further object of this invention to provide a valve means which is capable of directing air either back into the dwelling or directly outside the dwelling, where said valve assembly is provided with a bypass means to allow heated air to vent directly outside the dwelling in the event that the lint removal system becomes compromised to the extent that it is unable to allow sufficient flow of air back into the dwelling.

It is a further object of this invention to provide a means by which access to the valve assembly is available through an access door.

It is a further object of this invention to provide a dryer support that allows access to all air flow apparatus, without allowing the support itself to acquire latent heat energy which could then be transferred to the air within the dwelling, when this heat is undesired.

It is a further object of this invention to have this invention function with preexisting dryer construction limitations, so that the dryer support does not elevate the dryer itself beyond available space limitations.

DETAILED DESCRIPTION OF THE INVENTION.

Figure 1:
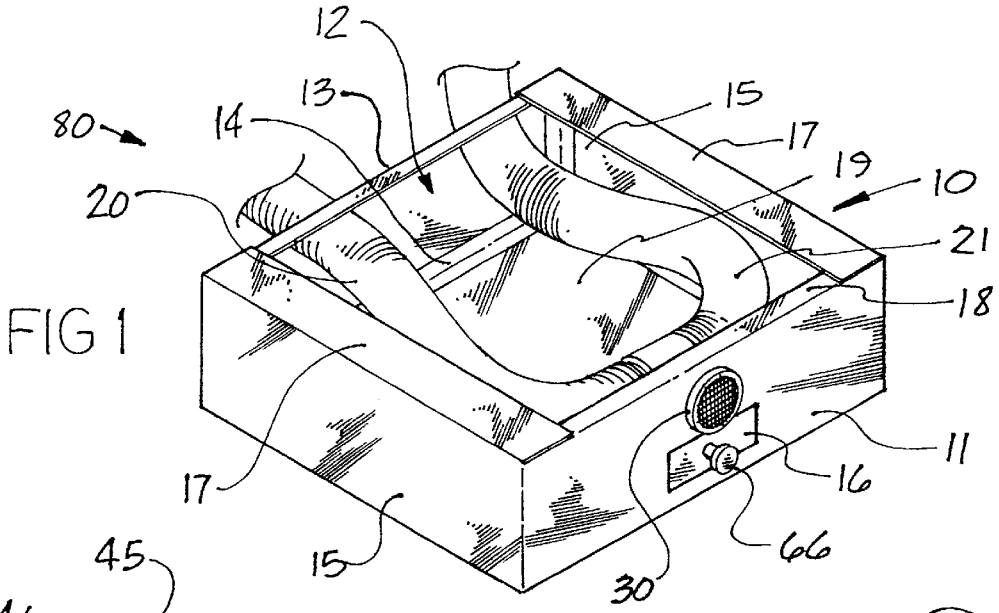
FIG. 1 is a perspective view of the apparatus, with the dryer vent hose and exterior vent hose properly positioned through the back opening and attached to the valve assembly.
Figure 2:
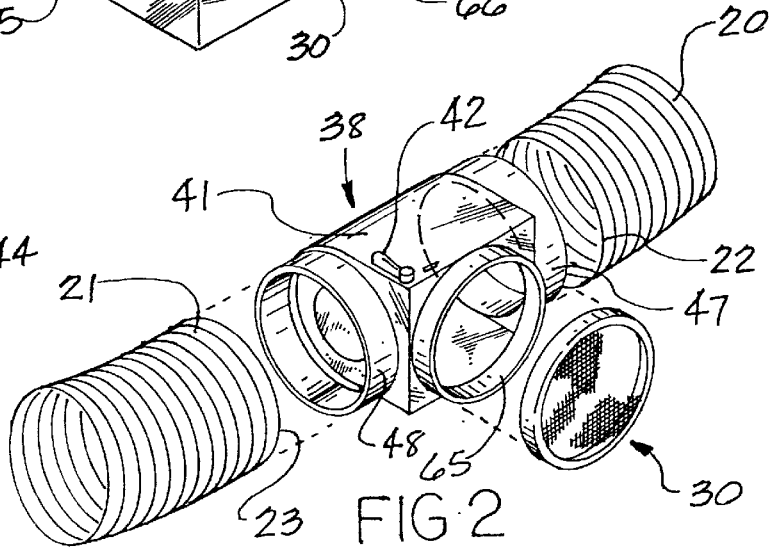
FIG. 2 is a perspective view of the valve assembly with the dryer vent hose, exterior vent hose and removable lint screen shown in exploded view as positioned for attachment to the valve assembly.
Figure 5:
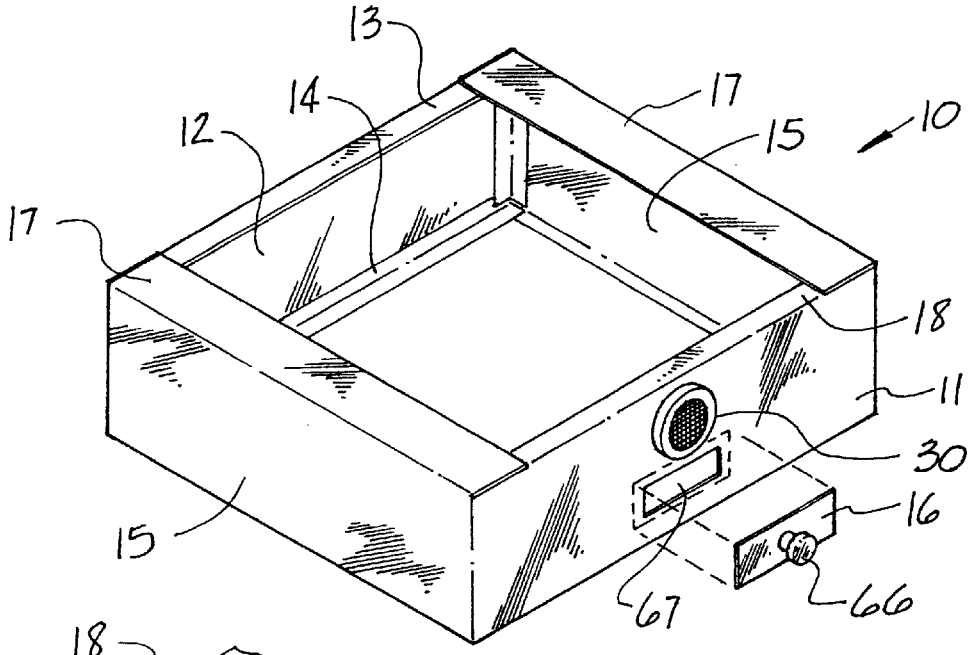
FIG. 5 is a perspective view of the dryer support with the valve assembly and dryer vent hose and exterior vent hose removed, showing the access door removed with the access opening unobstructed.

Referring to FIG. 1, the improved heated air recycler 80 is shown. This heated air recycler 80 is comprised of a dryer support 10, and a valve assembly 38, with said valve assembly 38 more fully shown in FIGS. 2,3, 7 and 8. The dryer support 10 is comprised of a rigid front side 11, with the ends of each front side 11 attached to a respective side wall 15, which are generally parallel to one another, and which are spaced apart by a bottom back edge 14 and back support surface 13, so as to form a generally square or slightly rectangular box. The dryer support 10 may have a solid bottom side 19, as is shown in FIG. 1, but this solid bottom side 19 may be entirely omitted as is shown in FIG. 5, of the entire recycler 80, as shown in FIG. 1, flipped over, so that the solid side 19 being the side which supports the bottom side of the dryer. The purpose and utility of side walls 15, front side 11 and back support surface 13 with bottom back edge 14 is to provide a sturdy means by which a clothing dryer (not shown) or similar device may be positioned above the normal floor support surface. The height of side wall 15 and front side 11 should be at least greater than the typical dryer vent hose 20, as shown in FIG. 2. Preferably, the height of the heat recycler 80 does not exceed nine inches. Many preexisting dryer units are located in areas that do not allow more than nine inches of clearance above them. Therefore, the side walls 15 and front side 11 should not exceed a height of nine inches. In situations where greater height is desired, however, this nine inch limitation may be exceeded.

Referring now specifically to FIG. 5, the top of each side wall 15 supports a side support surface 17, which is comprised of a strip of resilient material, that provides a suitable surface by which a clothing dryer may be set thereupon. As indicated above, the apparatus 80 may be flipped over, so that the top of each side wall 15, and side support surface 17, contact the floor or ground surface. The ends of said side support surfaces 17 are placed upon the front support surface 18, which defines the top of front side 11, and also are placed upon a back support surface 13 which extends from the top side of each side wall 15 to the opposing side wall 15. The width of side support surface 17 may be as shown in FIG. 1 and FIG. 5, where said side support surfaces 17 are only a few inches wide, but said side support surfaces 17 may extend all the way across the top of the front side 11, so as to completely enclose the area defined between the side walls 15 and front side 11. Where said side support surfaces 17 are comprised of strips that do not cover or enclose the area within the dryer support 10, a front support surface 18 may be utilized to assist in supporting a dryer that is placed upon the dryer support. Preferably though, the top side of the dryer support 10 will define a large opening, so that a user of this invention has easy access to items within the dryer support 10. In addition, access to the hoses may be desired, since proper maintaining of the apparatus 80 may require evacuation of particulate matter that accumulates in the system over time.

The opposing back side area of the dryer support 10 should define a back opening 12 which allows the insertion and continue placement of a dryer vent hose 20 and an exterior vent hose 21. The back opening 12 may be defined as a single rectangular opening as shown in FIG. 1 and FIG. 5, but may also comprised two or more openings separated by supports, as long as suitable space exists for the placement of said hoses 20 and 21.

The front side 11 of the dryer support 10 defines an interior discharge opening 64. The interior discharge opening 64 should have a diameter equal to that of the dryer vent hose 20. The interior discharge opening 64 is shown in greater detail in FIG. 6, and although said opening 64 is depicted as a circular opening defined by a filter receiving lip 65, the interior discharge opening 64 may be of any shape desired by the user of this invention, as long as sufficient area is defined by the interior discharge opening 64 so as to allow heated air to vent properly without building up undesired pressure within the dryer vent hose 20.

Also preferably located on the front side 11 is an access opening 67 which can be covered by an access door 16, as shown in FIG. 1 and FIG. 5. The access door 16 depicted in FIG. 1 and FIG. 5 is intended to be removed by applying pulling force on the handle 66 and lifting away the access door 16 from the front side 11. Access door 16 may be attached to front side 11 through the use of magnets, or any other means commonly known and understood to attach a door to a flat surface to affect closure of an opening. Although not shown, any type of means, such as hinges and catches would normally be anticipated as potential uses and means to utilize the access door 16.

Referring now to FIG. 2, a valve assembly 38 shown. This valve assembly 38 is comprised of a housing 41 that has opposably situated dryer hose receiving lip 47 and vent hose receiving lip 48, which allow the connection of the dryer vent hose 20 to dryer hose receiving lip 47, which preferably has an outer circumference that is less than the inner circumference of the dryer vent hose 20, so that when the dryer hose edge 22 is pulled over the dryer hose receiving lip 47, a tightening means may be used to keep the dryer vent hose 20 attached to the valve assembly 38.

The dryer vent hose 20 is attached at its other end (not shown) to the discharge air vent of a dryer (not shown). Air that has been heated and allowed to contact moist or wet items within a revolving drum, so that said heated air acquires some of the moisture content from the items, is forcibly blown out the dryer through the dryer discharge air vent, to which the therefore travel through the dryer vent hose 20 until discharged.

Since most dryers presently have a dryer vent hose 20 already attached to it, this invention is particularly adapted to using the existing parts of most dryers currently in use. The opening top side and back opening 12 allow the insertion of said dryer vent hose 20 directly into the confines of the dryer support 10, with the dryer hose edge 22 simply attached to the valve assembly 38. A second hose, being the exterior vent hose 21 is likewise attached to the valve assembly 38 by sliding its vent hose edge 23 over the vent hose receiving lip 48 and using a means to tighten the circumference of the exterior vent hose 21 around the vent hose receiving lip 48. Since the exterior vent hose 21 is preferably of the same material and size as the dryer vent hose 20, this part is readily available in the event of repair or replacement. The other end of the exterior vent hose 21 is attached to a discharge opening that is typically found in most dwellings, and prior to the use of this invention would have had the dryer vent those 20 attached to it. Any heated moist air that it is forced through the exterior vent hose 21 from the valve assembly 38 to the second end is intended to be vented directly back outside into the atmosphere.

Figure 4:
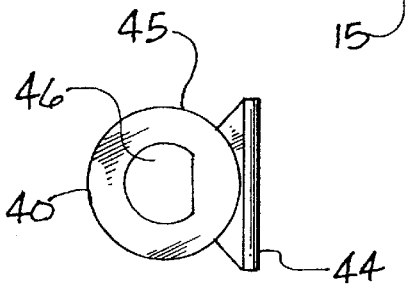
FIG. 4 is a view of the valve flap showing the bypass opening within said valve flap.

It should be noted that FIG. 2 is a perspective view of the bottom side of the valve assembly 38. Shown on the bottom side of the valve assembly 38 is a flap handle 42 which controls the movement of an inner valve flap 40, as shown in FIG. 4. Valve assembly 38 may be arraigned to as shown in FIG. 2 directly into the dryer support 10, but access to, the flap handle 42 should be preferably done through the access opening 67. FIG. 1 is intended to show the valve assembly 38 with the flap handle 42 on the bottom side of said valve assembly 38, so that a user of this invention may simply reach in through the access opening 67 to manipulate the flap handle 42. Since the dryer support 10 is only intended to provide a means to elevate a dryer, the dryer support to end may be flipped over, so that the access door 16 is located above the air discharge opening 64. In this instance, the bottom side 19 will actually become the top side of the dryer support and which will directly contact and support the bottom of the clothing dryer. It should be understood that the access door 16 is simply provided to allow easy access to the valve assembly 38 without the need to move or repositioned the dryer on top of the dryer support 10.

Figure 3:
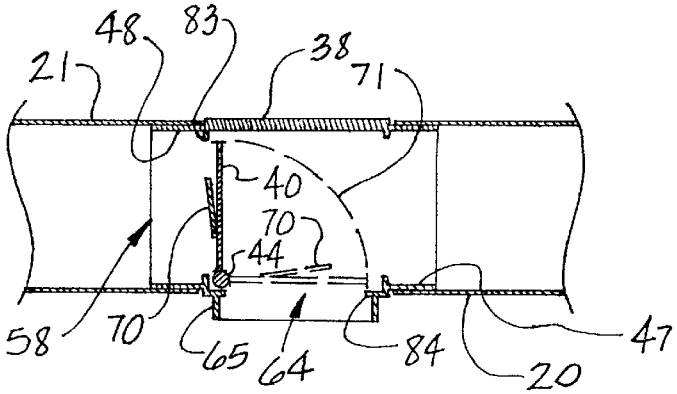
FIG. 3 is a cross sectional top view of the valve assembly with the dryer vent hose and exterior vent hose attached, with the two preferred positions of the valve flap and its path of travel shown.

Referring now to FIG. 3, the cross-sectional view of the valve assembly 38 is shown. Heated moist air moving through the dryer vent hose 20 will enter into the valve assembly 38, and will require venting through either the exterior vent hose port 58 or through the interior discharge opening 64, or through a combination of both 58 and 64.

Figure 7:
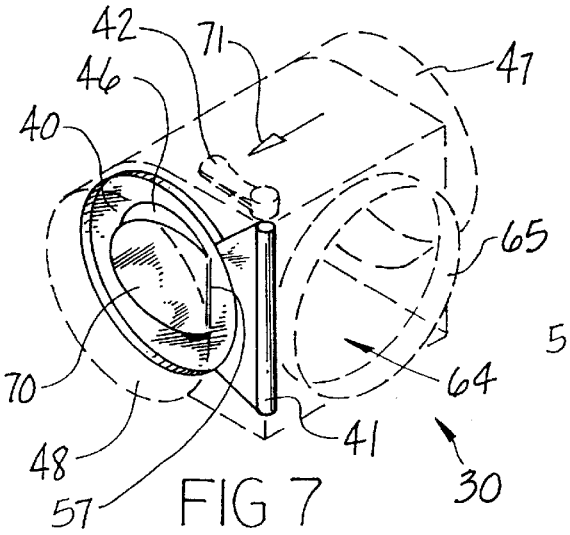
FIG. 7 is a perspective view of the valve assembly showing the flap valve positioned so as to direct the flow of heated air through the interior discharge opening.
Figure 8:
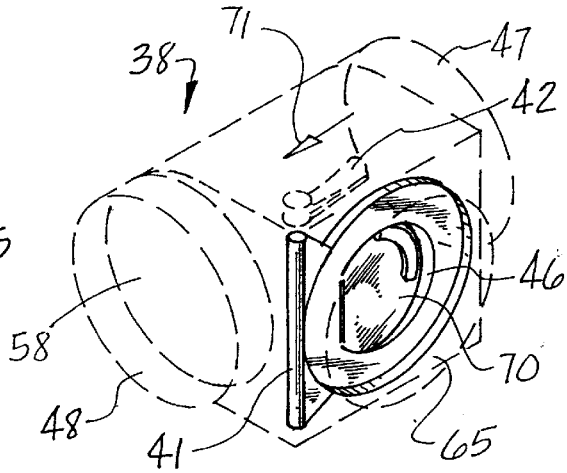
FIG. 8 is a perspective view of the valve assembly showing the flap valve positioned so as to direct the flow of heated air directly into the exterior vent hose port.

The valve assembly 38 is provided with a valve flap 40, which is depicted in FIG. 4. Valve flap 40 is generally shaped so as to provide a means to seal off the exterior vent hose support 58 or the interior discharge opening 64. This is accomplished with the flap edge 45 having a circumference that it is slightly greater than either port 48 or opening 64. The valve flap 40 pivots about on a hinge 44, which is incorporated directly into the valve assembly 38. The valve flap 40 is controlled by the flap handle 42, which is fixed to the valve flap hinge 44 so that as the flap handle 42 is turned, the valve flap 40 will move in a corresponding manner. Valve flap 40 is provided with a bypass opening 46. The bypass opening 46 is provided with a bypass flap 70, as shown in FIG. 7 and FIG. 8. The bypass flap 70 is not manipulated directly by a flap handle, but is moved due to the increase in air pressure against one side of the bypass flap 70.

The valve flap 40 has two main positions. The first position is provided whereby the heated moist air moving through the dryer vent hose 20 into the valve assembly 38 is intended and desired to be vented directly back into the room of the dwelling occupied by the dryer. In this situation, the valve flap 40 is positioned so that it covers the exterior vent hose port 58, with the valve flap 40 extending across from hinge 44 to exterior vent hose port catch 83, which extends inward into the area defined by the exterior vent hose port 58. This catch 83 prevents the valve flap 40 from moving into the exterior vent hose port 58 and provides a lip or ledge upon which the flap edge 45 may rest against to provide a uniform seal. This position is also shown in FIG. 7, in which the flap valve 40 has been manipulated by flap handle 42 to the position shown.

A second possible desired setting for the flap valve 40 is shown in FIG. 8, as well as shown from the top cross sectional view in FIG. 3. When the flap handle 42 is manipulated, the valve flap 40 will move along path of travel 71, as shown in FIG. 3, to interior discharge catch 84, which extends inward into the area defined by the interior discharge opening 64. This catch a 4 provides a means which prevents a valve flap from moving into the interior discharge opening, and also provides the lip or ledge upon which the flap edge 45 may rest against to provide a uniform seal. This position is also shown more fully FIG. 8, in which, the valve flap 40 has been manipulated by flap handle 42 to the position shown. In each instance, the air flow direction 71, as shown in FIG. 7 and FIG. 8 will be diverted into the room of the dwelling as shown in FIG. 7, or will be vented directly as shown in FIG. 8, to the outside air.

Figure 6:
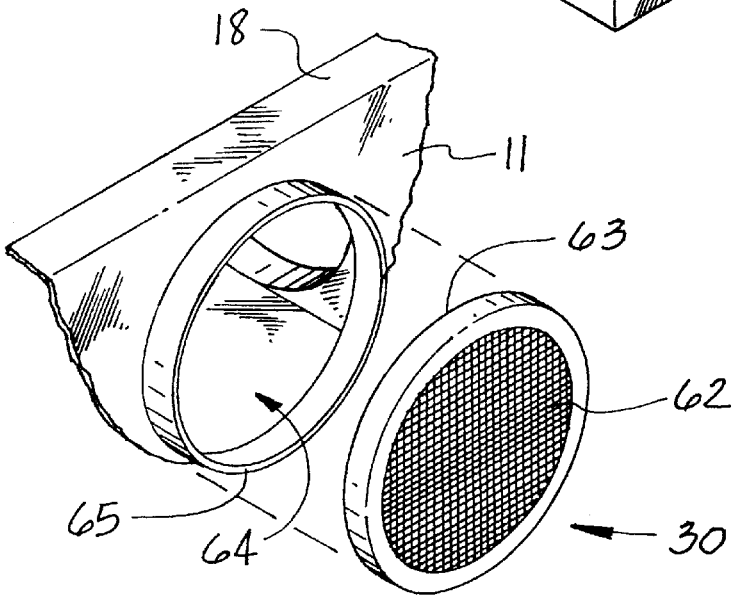
FIG. 6 is a perspective view of the interior discharge opening with the removable filter removed from the filter receiving lip, in which the screen mesh of said filter is shown.

This invention also provides a means to remove particulate matter from the warm moist air vented directly from dryer into the dryer vent hose 20. This means is provided through a removable lint screen 30, as shown in FIG. 6. The removable lint screen 30 is provided with a screen mesh 62, such as a cris-cross of closely spaced wires, or any other similar type filtering material means, which is stretched across an opening defined by a cover edge 63. The cover edge of the removable lint screen 30 is placed over the filter receiving lip 65 of the valve assembly, which protrudes through the front side 11 of the dryer support 10. The filter receiving lip 65 should have a circumference just slightly less than the interior circumference of the cover edge 63. It is preferable that the removable screen 30 have the capacity to remain in place on the filter receiving lip 65.

The filtering capacity of the removable screen 30 allows particular matter to be captured before-it is vented back into the dwelling, thus protecting nasal passages from undesired dust and air born debris. The removable screen 30 may be screwed on, attached to use of magnets, or simply attached through the gripping power of the cover edge 63 over the filter receiving 65. The removable screen 30 is preferably able to be removed quickly and easily from the filter receiving lip 65, so as to clean said screen of excess particles. Once cleaned, the screen 30 may be replaced back onto the filter receiving lip 65, to continue particulate matter removal from the air flow.

In the event that particulate matter accumulates on the screen mesh 62 so that movement of air through the screen mesh 62 is significantly reduced, a means is provided by which heated moist air may be vented directly outside, so as to avoid the buildup of pressurized moist heated air within the dryer vent hose 20 or within the dryer.

As is shown in FIG. 7, when the valve flap 40 is in the position whereby the heated moist air is diverted through the interior discharge opening, a bypass flap 70 will rotate slightly about its bypass flap hinge 57 so as to reveal a portion of the bypass opening 46 through which some. of the heated moist air that has an increased pressure is vented from the valve assembly 38 directly into the exterior vent hose 21. The bypass flap 70 is actuated through increased air pressure within the valve assembly 38, which pushes against and forces the bypass flap 70 to open. When the valve flap 40 is in the position shown in FIG. 8, the air moving through the valve assembly, even though pressurized, will not cause the bypass flap 70 to open. The bypass flap 70 preferably has a diameter which exceeds that of the bypass opening 46, so that the bypass flap 70 may only pivot open a single direction, that being into the direction of the exterior vent hose 21. In this matter, warm or heated moist air, when desired to be vented through the exterior vent hose port 58 into the exterior vent hose 21 and outside, should not vent at all through the interior discharge opening 64. This invention therefore provides a means to direct warm moist air out of the dwelling without any significant amounts leaking back into the dwelling during warm weather. This invention also provides the means by which during cold weather, warm or heated moist air can be directed into a dwelling through the interior discharge opening 64, and can be left at this setting without any, appreciable risk of particulate matter likewise being vented back into the dwelling. The removable screen 30 is not only able to be cleaned with minimal effort, but in the event the user forgets or omits to keep the screen 30 free of excess particle matter, the bypass flap 70 will provide a means for air to safely vent without causing a buildup of pressure with regard to be heated air within the dryer vent hose 20. This invention therefore provides safety and convenience with regard to the recirculating of warm moist air, while also able to safely direct all of the moist heat air out of the dwelling when desired.

From the foregoing statements, summary and description in accordance with the present invention, it is understood that the same are not limited thereto, but are susceptible to various changes and modifications as known to those skilled in the art and we therefore do not wish to be limited to the details shown and described herein, but intend to cover all such changes and modifications which would be encompassed by the scope of the appended claims.

I claim:

1. An improved heat recycler, for use with a dryer, which is able to direct warm moist air that has been expelled by a clothes dryer either into a dwelling, or direct the air outside of the dwelling, or both, with the heated air safely vented outside without any significant amount of heat expelled into the dwelling during warm weather, comprising:

a. A dryer support, having a front side, and two side walls that are spaced apart by a bottom back edge, so as to form a generally square or rectangular shape, upon which a clothing dryer is able to be set and supported by said dryer support where a back opening is defined by a bottom back edge, the pair of side walls, and a bottom back edge, having a sufficient size so that a dryer vent hose may be placed through said back opening;

b. An interior discharge vent opening defined by the front of the dryer support, through which heated air vented from the dryer may pass through;

c. A valve assembly, positioned within the dryer support. having a dryer hose receiving lip, which has the end of the dryer vent hose fixed to it, so that the valve assembly is capable of receiving heated air that has been vented from the dryer through the vent hose, and where said valve assembly also comprises a vent hose receiving lip, upon which a vent hose is fixed, and which provides an outlet for heated air from the valve assembly out of the dryer support, to an exterior wall;

d. A valve flap, contained within the valve assembly, which is able to be manipulated so that when the flow of air from the dryer moves from the dryer vent hose, into the valve assembly, the position of the valve flap will:

i. direct the air into the exterior vent hose to be expelled outside of the dryer area, when the valve flap blocks the flow of air into the interior discharge opening, or:

ii. direct the air into the interior discharge opening, when the valve flap blocks the flow of air into the exterior vent hose, causing the air to be expelled into the dryer room area, or;

iii. direct the air into both the interior discharge opening and the exterior vent hose, so that air moves both into the dryer room area, and concurrently is vented into the exterior of the dryer area, when the valve flap is positioned so that it allows air to move into both areas.

2. An improved heat recycler, as recited in claim 1, in which a filter means is placed over the interior discharge opening, where said filter is capable of collecting particulate matter in the heated air that is vented through the interior discharge opening, and where said filter means is able to be removed from the discharge opening.

3. An improved heat recycler, as recited in claim 1, in which the valve assembly includes a valve flap having a bypass opening defined by said valve flap, which is able to be opened by air pressure within the valve assembly, so that pressurized heated air, received from the dryer vent hose, will automatically be discharged through the exterior vent hose, if air flow is restricted through the interior discharge opening, causing a buildup in pressure within the valve assembly.

4. An improved heat recycler, as recited in claim 1, in which the valve assembly defines a flap that may be manually manipulated through a flap handle, to prevent air received from the dryer vent hose from entering either the dyer vent hose or the interior discharge opening.

5. An improved heat recylcer, as recited in claim 1, in which the front side defines an access opening, which is able to be covered by an access door, where when said access door is opened, the valve assembly, which is positioned within the dryer support is able to be manipulated or serviced.

* * * * *